US006036914A

United States Patent [19]

Diederich et al.

[11] Patent Number: 6,036,914

[45] Date of Patent: Mar. 14, 2000

[54] DUMPING BAY WITH FUME COLLECTING PROVISIONS

[75] Inventors: David J. Diederich; John C. Paddock, both of Avon Lake; Thomas F. Bernarding, North Ridgeville; Donald M. Watkins, Beloit, all of Ohio

[73] Assignee: USS/KOBE Steel Company, Lorain, Ohio

[21] Appl. No.: 09/074,797

[22] Filed: May 8, 1998

Related U.S. Application Data

[60] Provisional application No. 60/069,682, Dec. 12, 1997.

[51] Int. Cl.[7] ..... C21B 7/00

[52] U.S. Cl. ..... 266/142; 266/158; 266/903; 55/385.5

[58] Field of Search ..... 266/142, 143, 266/158, 159, 903; 373/8, 9, 81; 55/385.5, 385.7

[56] References Cited

U.S. PATENT DOCUMENTS

| | | | |
|---|---|---|---|
| 2,803,450 | 8/1957 | McFeaters | 266/143 |
| 3,380,371 | 4/1968 | Scheel . | |
| 3,539,168 | 11/1970 | Pfeuffer . | |
| 3,604,697 | 9/1971 | Kawana . | |
| 3,648,996 | 3/1972 | Yonezawa et al. . | |
| 3,809,376 | 5/1974 | Plazier . | |
| 4,050,367 | 9/1977 | Eakes . | |
| 4,050,682 | 9/1977 | Baum . | |
| 4,081,269 | 3/1978 | Nomine et al. . | |
| 4,243,208 | 1/1981 | Laimer . | |
| 4,256,289 | 3/1981 | Neuner et al. . | |
| 4,270,738 | 6/1981 | Dangeleit et al. . | |
| 4,359,177 | 11/1982 | Noto La Diega . | |
| 4,379,548 | 4/1983 | Boshoven . | |
| 4,410,166 | 10/1983 | Hixenbaugh et al. | 266/158 |
| 4,460,389 | 7/1984 | Baum et al. . | |
| 4,527,609 | 7/1985 | Nugent . | |
| 4,568,065 | 2/1986 | Talonen . | |
| 4,724,895 | 2/1988 | Mulesa . | |
| 4,792,123 | 12/1988 | Moser et al. . | |
| 4,836,510 | 6/1989 | Weber et al. . | |

*Primary Examiner*—Scott Kastler
*Attorney, Agent, or Firm*—Fay, Sharpe, Fagan, Minnich & McKee, LLP

[57] ABSTRACT

An improved dumping bay particularly adapted for preventing the escape of hazardous fumes into other areas of a facility is disclosed. The dumping bay is fully enclosed and utilizes a unique air flow routing technique for collecting fumes, such as from a ladle during a slag dumping operation.

5 Claims, 4 Drawing Sheets

DUMPING BAY WITH FUME COLLECTING PROVISIONS

CROSS-REFERENCE TO RELATED APPLICATIONS

The present application claims priority from U.S. provisional application Ser. No. 60/069,682, filed Dec. 12, 1997.

BACKGROUND OF THE INVENTION

1. Field of the Invention

The present invention relates to a fully enclosed and self-contained dumping bay such as may be utilized in metallurgical operations, and particularly, for example, in steelmaking. The dumping bay has among other features, fume collecting provisions for capturing and collecting hazardous fumes emitted within its interior.

2. Description of the Related Art

It is well known that certain metallurgical processing operations emit or generate hazardous, or at least potentially hazardous, fumes and dust. This is particularly the case in the manufacture of leaded steel in which hazardous fumes and dust containing the known carcinogen lead, are emitted.

Significant amounts of lead-containing fumes or dust are emitted when dumping slag from the manufacture of leaded steel. This operation involves transporting an empty or nearly empty ladle, however still containing slag, to an area at which the contents of the ladle are transferred to a slag pot. Typically, this transfer is achieved by tilting the ladle to an inverted position so that slag contained in the ladle falls into the slag pot positioned under the inverted ladle. As will be appreciated, this operation results in the emission of copious amounts of lead-containing fumes, dust, and gases during the dumping operation.

Accordingly, prior artisans have devised numerous fume collecting devices for use with various metallurgical containers such as ladles. In one approach, artisans provided movable fume collecting devices for placement near these containers during dumping operations. For example, in U.S. Pat. No. 3,604,697, Kawama et al. described a movable hood assembly that may be placed over the mouth of a ladle to collect fumes therefrom. Alternatively, Plazier, in U.S. Pat. No. 3,809,376 described a stationary hood that, when a tiltable container positioned underneath the hood is rotated into alignment and engaged with the hood, collects hazardous vapors exhausted from the container. This technique was also adopted by Neuner et al. in U.S. Pat. No. 4,256,289 and by Laimer in U.S. Pat. No. 4,243,208. Yet another approach to collecting fumes is to extend a duct directly to a cover for the particular metallurgical vessel and ensure that the vessel is covered while removing the hazardous fumes from the vessel through the duct. This approach is illustrated in U.S. Pat. No. 4,792,123 to Moser et al. and U.S. Pat. No. 4,836,510 to Weber et al.

Although satisfactory in many respects, there are several disadvantages associated with each approach. The use of a movable hood assembly is undesirable in that the hood must be properly placed alongside the vessel or container of interest. This is not possible if the vessel is still relatively hot. Additionally, after the necessary operations have been performed concerning placement of the hood alongside the vessel and its contents, the hood must be moved away from the vessel. These operations all require additional labor. Furthermore, the use of a movable hood also requires additional hardware and maintenance associated with the components of the hood enabling its selectively movable feature.

If instead, one uses a stationary hood and a rotatable vessel that is engaged with the hood, equipment must be provided to support and maintain alignment between the hood and vessel. The hardware associated with this technique is also relatively expensive. Additionally, precautions must be taken with regard to the extremely high temperatures potentially existing in and around the vessel. This is particularly so due to the very close proximity between the hood and the vessel.

The third approach, i.e. the use of a ducted cover without any other fume collecting provisions, is not feasible when the vessel must be tilted or inverted to transfer its contents to another container. If this approach were utilized in a slag dumping operation, significant amounts of fumes and vapors would escape into the surrounding environment from the uncovered vessel during dumping. Accordingly, in view of the numerous disadvantages associated with each of the prior art approaches to collecting fumes, there is a need for an improved apparatus and technique for collecting fumes during an operation involving the transfer of contents from one metallurgical vessel to another.

Moreover, it would be particularly beneficial to provide protection against the excessive amounts of thermal and radiant energy emitted from a metallurgical vessel and its contents during certain dumping operations. If dumping occurs in a dedicated region or enclosure within a facility, it is burdensome and typically not feasible to incorporate significant amounts of heat resistant material in certain enclosure components such as doors. This is largely due to the high densities and weight of most heat resistant materials such as ceramics. The use of such materials in doors for instance, significantly increases the weight and difficulty in operating those components. Additionally, the hardware associated with such heavy components must be strengthened, thereby further increasing costs. Accordingly, there is a need for a technique and apparatus for providing protection against excessive amounts of thermal and radiant energy emitted during a transfer operation. Specifically, there is a need for eliminating the requirement of incorporating heat resistant materials into enclosure components such as doors.

SUMMARY OF THE INVENTION

The present invention achieves the foregoing objectives and provides, in a first aspect, an enclosed bay comprising (i) a sealable enclosure, (ii) an exhaust providing exit of air flow from the interior of the enclosure, (iii) one or more intakes providing entry of air flow into the enclosure, (iv) an air moving assembly, (v) at least one door and door opening in the enclosure, and (vi) a movable heat shield that may be placed in a position to protect one or more doors in the enclosure.

In another aspect, the present invention provides a dumping bay comprising (i) a multi-walled enclosure providing a pair of air intakes, (ii) a bifold door assembly horizontally positionable between retracted and extended positions within a door opening in the enclosure, (iii) a roll-up door assembly vertically positionable between retracted and extended positions within another door opening in the enclosure, (iv) an exhaust duct providing communication to the interior of the enclosure, and (v) an air handling assembly for effecting air flow from at least one of the air intakes, through the enclosure, and through said exhaust duct.

In yet another aspect, the present invention provides a method for collecting fumes from a metallurgical vessel by utilizing the previously described bay. The method involves moving a covered metallurgical vessel through a door in the enclosure, closing the door, initiating operation of an air moving assembly, uncovering the vessel thereby enabling fumes or dust in the vessel to escape into the interior of the enclosure. Upon escape of the fumes or dust, the operation of the air moving assembly directs the fumes or dust to exit the enclosure.

DESCRIPTION OF PREFERRED EMBODIMENTS

Figure 1:
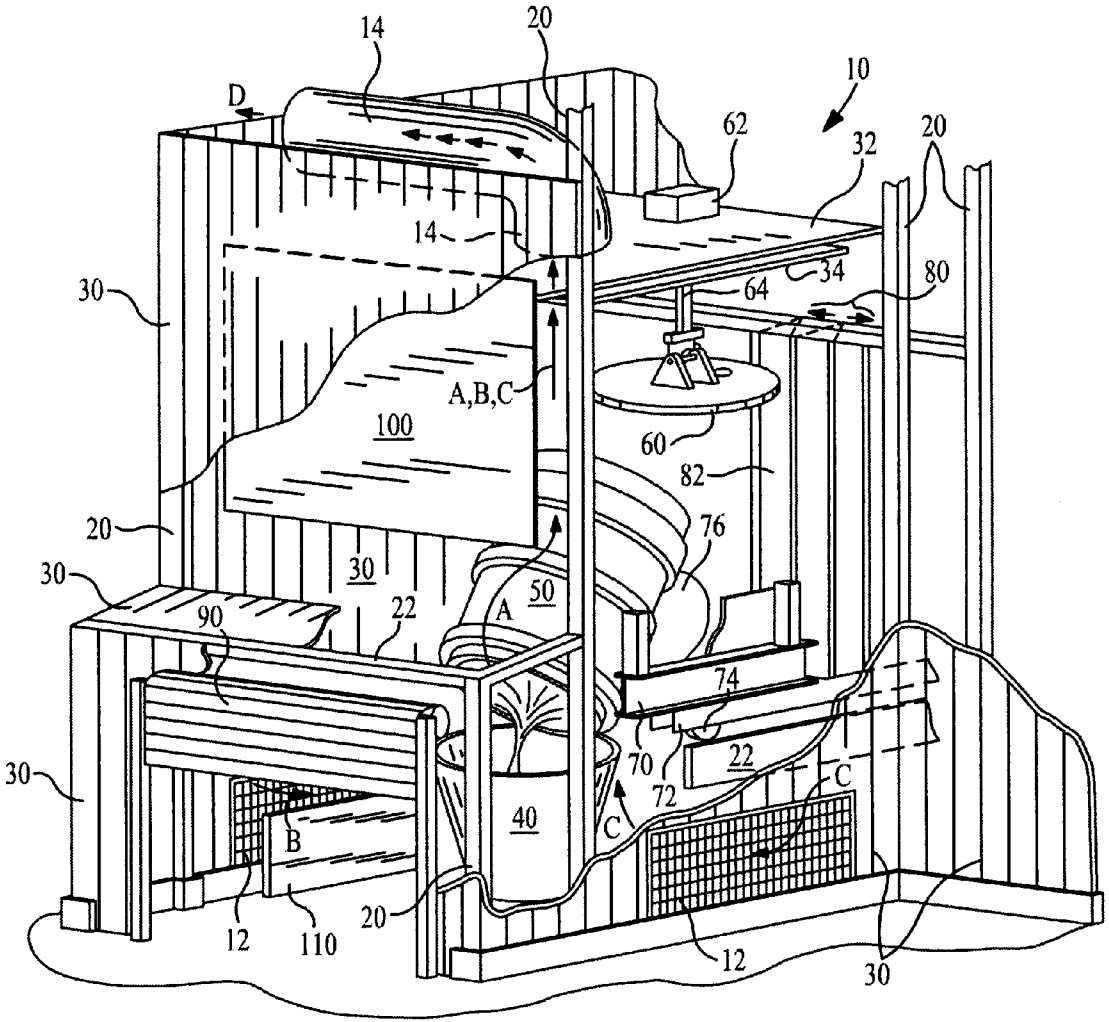
FIG. 1 is a partial sectional perspective view of a preferred embodiment dumping bay in accordance with the present invention.

FIG. 1 illustrates a preferred embodiment dumping bay 10 in accordance with the present invention. The dumping bay 10 is particularly adapted to capture and collect hazardous agents emitted within its interior. The term "hazardous agents" as used herein includes agents, components, and particles of materials or components that are hazardous or potentially hazardous to human health, or which are considered to be pollutants or contaminants and which may be carried, entrained, or otherwise transported by a moving air flow or gas flow. The preferred embodiment dumping bay 10 comprises a frame assembly including a plurality of vertical support members 20 and horizontal support members 22, an exterior wall 30 supported by the support members 20 and 22 and generally defining the bounds of the dumping bay 10, a top wall 32, and one or more protective panels 34, heat shields 100, and protective lower panels 110 disposed within the dumping bay 10.

The dumping bay 10 houses a first metallurgical vessel, such as a stationery slag pot 40, a second metallurgical vessel, such as a ladle 50, a ladle tilter 70 for supporting and rotating or pivoting the ladle 50, and a ladle carriage 72 for transporting the ladle 50 to the dumping bay 10 and for subsequent manipulation by the ladle tilter 70. As shown in FIG. 1, the first and second vessels are preferably arranged and supported within the dumping bay 10 such that one of the vessels is elevated above the other. In the preferred arrangement described herein, the ladle 50 is elevated above the slag pot 40. The ladle carriage 72 utilizes a plurality of wheels or rollers 74 to enable it and its contents such as the ladle 50 to be moved from one location to another. The ladle tilter 70 uses a tilting mechanism 76 to tilt or invert the ladle 50 to the position shown in FIG. 1. A frame section formed from one or more horizontal support members 22 is provided for supporting the ladle carriage 72, the ladle tilter 70, and the ladle 50. The frame section may include one or more tracks or pathways upon which the ladle carriage 72 may travel.

The dumping bay 10, and particularly its enclosure defined by the support members 20 and 22 and exterior wall 30 and top wall 32, includes one or more door assemblies that provide access into and exit from the dumping bay 10. It is preferred that the dumping bay 10 include a bifold door assembly 80, preferably along a first wall of the dumping bay 10. The bifold door assembly 80 preferably comprises two half sections that each retract toward a respective side of the door opening in the first wall. Each half section of the door assembly 80 preferably comprises a plurality of door panels 82. The panels 82 are preferably hingedly connected along one or more vertical axes between adjacent panels 82 when each half section is disposed within the door opening. The half sections may be fully extended toward one another until a distal end of a respective section engages with the other distal end of the other section. It is also preferred that a sealing material or gasket is utilized between all interface regions of the door assembly 80 and the door opening. The dumping bay 10 also preferably includes a second door 90 along a second door opening defined along a wall opposite from the wall at which is located the bifold door assembly 80. The door 90 is preferably a flexible door, and most preferably a roll-up door as known in the art. The door 90 provides access to, and exit from, the interior of the dumping bay 10. It is also preferred that a sealing material or gasket be provided between the door 90 and its respective door opening. Most preferably, the second door 90 provides access to, and exit from, a lowermost region of the interior of the dumping bay 10, such as where the slag pot 40 is positioned. It is also preferred that the other door, the bifold door 80, provides access to, and exit from, an elevated region of the dumping bay interior, such as where the ladle 50 is positioned.

One or more movable heat shields 100 are preferably provided along one or more walls of the dumping bay 10. The heat shields 100 are preferably located along the same walls having the previously noted first and second door openings. The heat shields 100 are preferably lowered to cover or block exposure to a door opening and its respective door such as the second door opening and its door 90. This may be desirable during certain operations in which significant amounts of heat or radiant energy are emitted, such as during a pouring or dumping operation. Similarly, although not shown in FIG. 1, it may also be preferred to provide a second movable heat shield positioned along the first wall proximate the bifold door assembly 80. The heat shield 100 dedicated for the door 90, is preferably movable along one or more trackways disposed within or along the wall 30, of the dumping bay 10. The heat shield 100 may be manually or automatically moved to the desired position.

It is also preferred to provide a protective lower panel 110 at least partially circumscribing the lower periphery of the dumping bay 10. The lower panel 110 preferably protects one or more air intakes 12 described in greater detail below. That is, the lower panel 110, or a portion thereof, may be disposed in front of one or both air intakes 12. The lower panel however, is spaced from the intake 12 so that the panel 110 does not seal off and block air flow through the air intake 12. Preferably, the lower panel 110 is formed from concrete or other masonry type materials.

The floor of the preferred embodiment dumping bay is formed from any durable and heat resistant material such as concrete or other masonry type materials. It is contemplated that the lower panel 110 could be integrally formed in whole, or in part, with the floor of the dumping bay 10.

The preferred embodiment dumping bay 10 also comprises a unique fume collecting and air handling system. The dumping bay 10 includes a pair of air intakes 12, preferably provided in a third wall and a fourth wall, each wall extending between the previously noted first and second walls. Most preferably, the air intakes 12 are located proximate to the lower region of the dumping bay 10 and most preferably near the floor of the bay 10. Each air intake 12 preferably comprises a plurality of adjustable louvers that, depending upon their orientation, allow varying amounts of air flow into the dumping bay 10. Moreover, by varying the relative positions of each set of louvers, air flow characteristics within the interior of the bay 10 may be changed. A venting duct 14 for directing air flow and collecting fumes from the dumping bay 10 is provided along the top wall 32 as shown in FIG. 1. As will be appreciated, an air moving device such a blower or fan (not shown) is in communication with the duct 14, the operation of which creates a pressure differential thereby causing air flow through the dumping bay 10 and into the duct 14. This is also described in greater detail herein.

The dumping bay 10 further comprises a ladle cover lifter 62 for lifting and suspending a ladle cover 60 that is disposed upon and covering the ladle 50 as the ladle 50 is transported into the dumping bay 10. The ladle cover lifter 62 may utilize a cable or chain 64 for attachment and affixment to the cover 60. The ladle cover lifter 62 preferably utilizes an electric winch or geared motor assembly to lift the cover 60 upward. An important feature of the preferred embodiment dumping bay 10 is that there is no cable access or opening in the roof or ceiling of the dumping bay through which the cable must pass. Or, if the lifter assembly 62 is disposed on the upwardly directed face of the top wall 32, thereby necessitating an opening therein for the cable 64, a sealing enclosure is provided about the assembly 62 to prevent the passage of hazardous agents from the interior of the bay 10. This further promotes the self-contained and fully enclosed feature of the preferred embodiment dumping bay.

Figure 2:
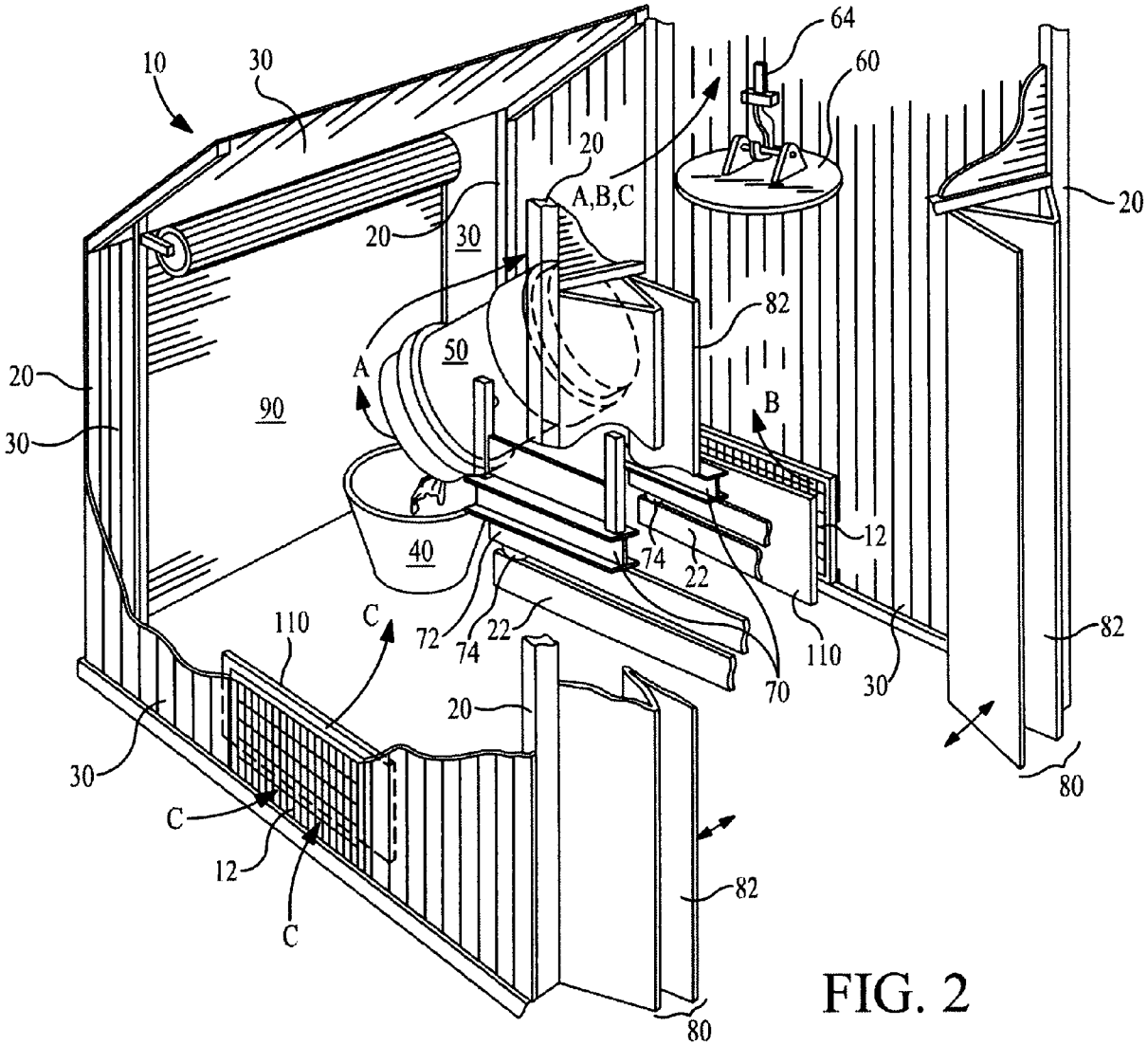
FIG. 2 is a partial sectional perspective view of the preferred embodiment dumping bay taken from an end opposite the end shown in FIG. 1.

FIG. 2 further illustrates the preferred embodiment dumping bay 10, and particularly its interior. In this view, the interior side and roll-up feature of the door 90 is shown. The ladle carriage 72, ladle tilter 70, and supporting frame section are shown in a simplified or schematic form.

Figure 3:
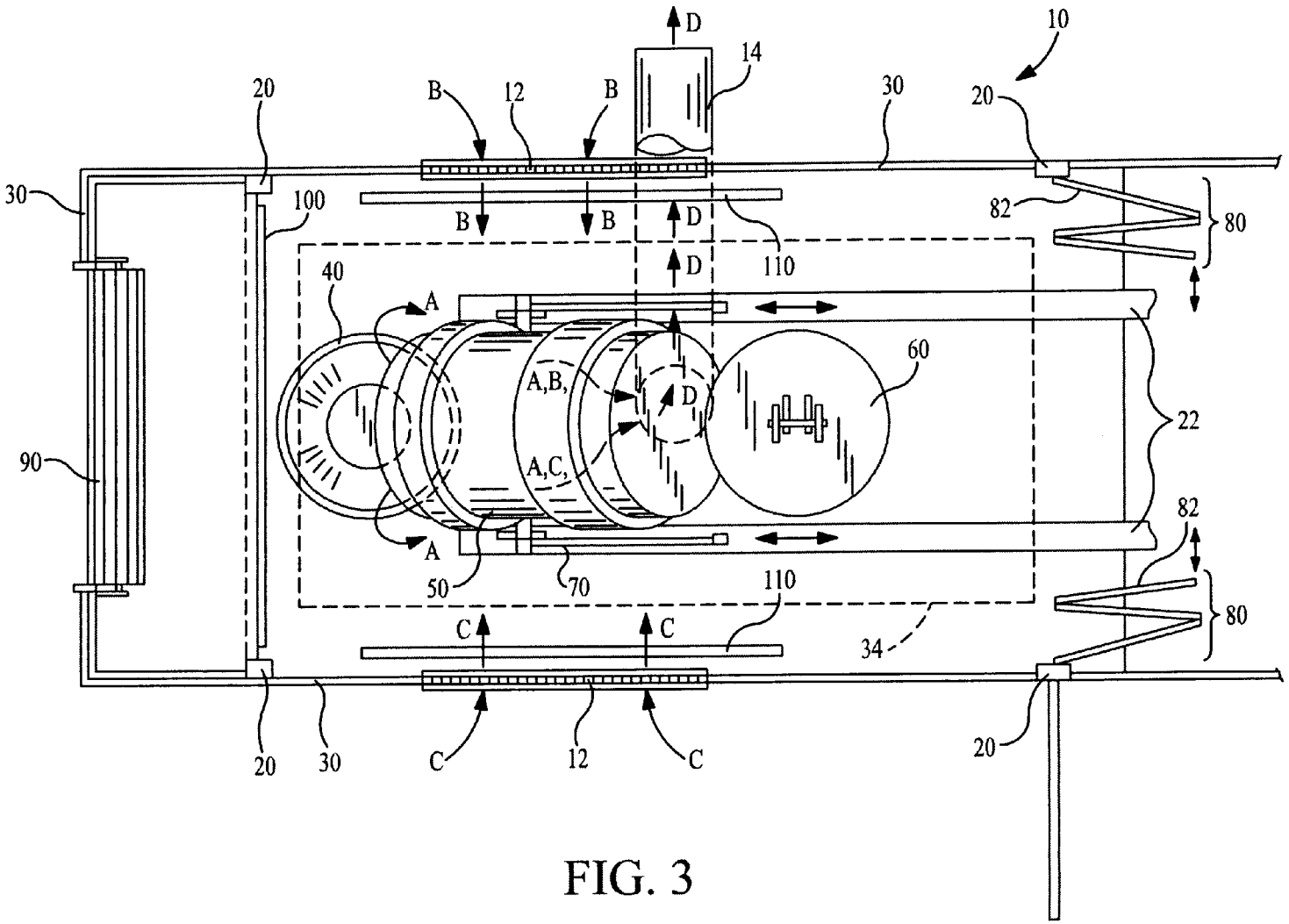
FIG. 3 is a plan view of the preferred embodiment dumping bay.

Referring to FIG. 3, a plan view of the preferred embodiment dumping bay 10 is shown. FIG. 3 illustrates the unique airflow routing scheme achieved by the preferred embodiment dumping bay 10. Upon appropriate positioning and tilting of the ladle 50, fumes designated by the arrows A escape from the exposed or uncovered top face of the ladle 50. It will be appreciated that the top or open end of the ladle 50 is directed downward when the ladle 50 is titled. The previously noted air moving system such as a blower in communication with the duct 14, draws the fumes A and other air from within the dumping bay 10 into the duct 14. The one or more air intakes 12 disposed within the exterior walls of the dumping bay 10 enable relatively fresh air from outside the bay 10 to enter the dumping bay 10 and be drawn into the venting duct 14. This secondary air flow through the one or more air intakes 12 is illustrated as arrows B and C. Upon collection of the air streams or fumes A, B and C, into the venting duct 14, the collective stream, designated as arrow D, is drawn toward the air moving device and subsequently directed to cleaning or filtering components for removal of harmful or undesirable agents or particles. This preferred air routing scheme, i.e. that shown by arrows A–D, is referred to herein as a two-stream converging air flow. This air flow scheme typically results in the creation of two, relatively laminar, and often high velocity, paths of flow, each extending from an air intake upward to a common exhaust. The two paths converge at the exhaust and are directed out of the interior of the dumping bay. The use of relatively high velocity laminar air flows promotes entrainment and carrying away of particles and other contaminants from the bay interior.

The dumping bay 10 is preferably used as follows. Referring to FIGS. 1–4, an empty, or nearly empty ladle 50, containing residual slag, is transported to the dumping bay 10 on the ladle carriage 72. During transport, the cover 60 is positioned on and covering the open top of the ladle 50 to prevent hazardous fumes from escaping the ladle interior. Once the bifold doors 80 are opened, as shown in FIG. 2, to provide access to the interior of the dumping bay 10, the ladle 50 and its cover 60 are moved into the dumping bay 10.

Once the covered ladle is properly located within the interior of the dumping bay, the bifold doors 80 are closed. A check is also made to ensure that the door 90 on the opposite end of the dumping bay is closed. Verification or sensing of a door position within a corresponding door opening may be performed by conventional sensors known to those skilled in the art. Properly positioning the covered ladle also involves properly positioning the ladle 50 within the ladle tilter 70. Once such proper positioning occurs, and preferably, is verified such as by one or more feedback signals such as from limit switches, position switches, proximity switches, or other sensors, the dumping operation may be initiated. At this juncture, it is preferred to lower the movable heat shield 100 in front of its respective door. In the dumping bay 10 described herein, the heat shield 100 is positioned alongside door 90. It may also be preferred to position a heat shield in front of the bifold doors 80. Positioning the heat shield 100 in front of a door protects the door and any associated seals from heat radiating from the ladle, and particularly from its contents and interior during dumping.

Once all doors, i.e. doors 80 and 90, are fully closed and preferably verification is made of such closure, the air handling system is initiated. Operation of the blower or fan assembly in communication with the duct 14, draws air from within the interior of the dumping bay 10 through the duct 14, and out of the dumping bay. The air is preferably directed to a baghouse where one or more filtering operations are performed to remove hazardous agents from the air flow. Depending upon the position of the louvers covering each of the air intakes 12, air is drawn into the interior of the dumping bay 10. Having established air flow within the bay 10, the dumping operation may begin.

Before dumping of a ladle 50 is initiated, the ladle cover 60 is lifted off or away from the ladle 50. This is preferably accomplished by lowering a lifter chain or cable assembly such as the lifter assembly 64, having an end adapted to releasably engage the cover 60. Once the lifter assembly 64 and the cover 60 are engaged to one another, the ladle cover lifter 62 raises the cover 60 off of, and away from, the ladle 50. This operation exposes the interior of the ladle and allows fumes from within the interior of the ladle 50 to escape into the dumping bay 10.

Slag or other residual matter is transferred from the ladle 50 to the slag pot 40 by tilting the ladle 50. Tilting is performed by the ladle tilter 70. Upon initiation of a tilting operation, the ladle tilter 70 engages the ladle 50 residing on the ladle carriage 72 and lifts the ladle 50 upward and preferably through an arc so that the ladle 50 is also linearly displaced from the carriage 72 toward the slag pot 40. Most preferably, the ladle 50 is also simultaneously pivoted about a horizontal axis extending through its midsection to accomplish tilting.

As will be understood, once a sufficient angle of tilt of the ladle 50 is achieved and the ladle is positioned over the slag pot 40, the slag and contents of the ladle 50 essentially fall into the slag pot 40. Once the ladle 50 has been sufficiently emptied, the ladle tilter 70 is operated to return the ladle 50 to its original position. The cover 60, suspended above, may then be lowered onto the ladle 50. The air moving system is operated until all residual dust or fumes in the interior of the dumping bay have been sufficiently removed. The one or more heat shields 100 are then returned to their original position, thereby allowing access to the doors 90 and/or 80. The pair of bifold doors 80 may then be opened to allow the ladle carriage 72, the ladle 50, and the cover 60 to be moved out of the dumping bay 10. The slag pot 40, now containing slag and other residual materials formerly within the ladle 50, may be removed from the dumping bay 10 through the door 90.

Figure 4:
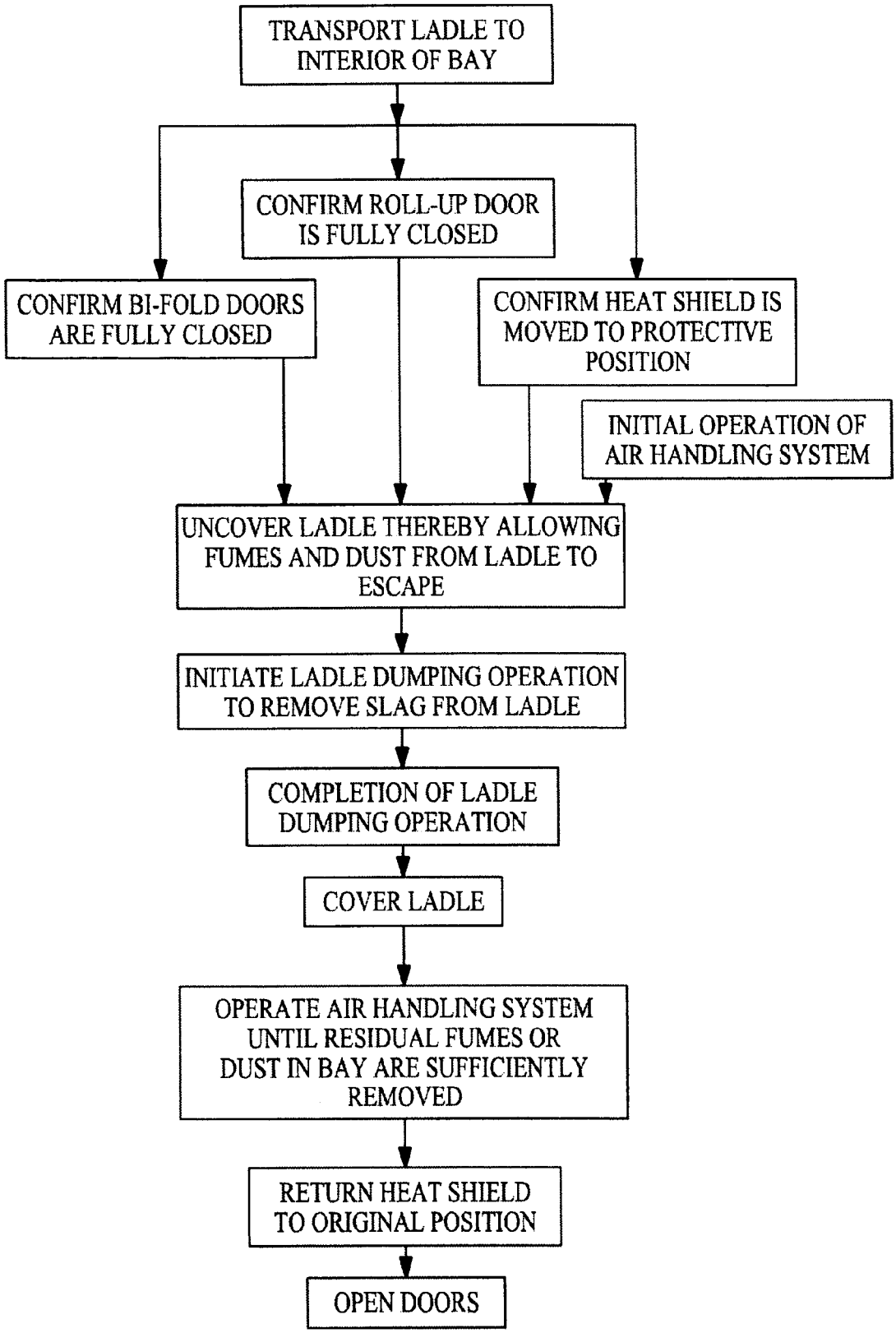
FIG. 4 is a block diagram illustrating a preferred process for operating the preferred embodiment dumping bay.

It is to be understood that FIG. 4 illustrates a preferred technique for operating the preferred embodiment dumping bay 10. The present invention includes numerous variant techniques for operating the bay. Furthermore, the techniques of the invention include other combinations and sequences of interlocks and monitoring the position or state of components of the dumping bay, for instance the position of the doors. That is, it may in some applications, be desirable to initiate operation of the air handling system before, during, or only after confirmation that one or both doors are fully closed and/or that the heat shield is lowered to its protective position. Other process variations are encompassed within the present invention.

The invention has been described with reference to the preferred embodiments. Obviously, modifications and alterations will occur to others upon a reading and understanding the preceding detailed description. It is intended that the invention be construed as including all such modifications and alterations in so far as they come within the scope of the appended claims or the equivalents thereof.

What is claimed is:

1. An enclosed bay adapted for capturing hazardous agents emitted during transfer of material from a vessel within said bay, said bay comprising:

a sealable enclosure defining an interior;

an exhaust port defined within an upper region of said enclosure, said exhaust port providing exit of air flow from said interior of said enclosure;

at least one intake port defined within a lower region of said enclosure, said at least one intake port providing entry of air flow into said interior of said enclosure;

an air moving assembly in communication with said exhaust port and said intake port, wherein upon operation of said air moving assembly, hazardous agents within said interior are transported through said exhaust port and out of said interior of said enclosure;

at least one door opening defined within said enclosure and a door positionable within said door opening between a closed position and an opened position; and a movable heat shield movable between a first position in which said heat shield is disposed proximate to and alongside said door in its closed position in said door opening, and a second position in which said heat shield is displaced away from said door opening.

2. The bay of claim 1 further comprising:

at least one lower protective panel disposed within said interior of said bay and at least partially covering said at least one intake port.

3. The bay of claim 1 wherein said at least one intake port includes two intake ports, each said intake port comprising a plurality of adjustable louvers to govern air flow through said intake port.

4. The bay of claim 1 further comprising:

a motorized lifting assembly affixed to said upper region of said enclosure, said lifting assembly adapted to lift a cover from said vessel disposed in said bay.

5. The bay of claim 1 wherein said at least one intake port includes two intake ports, each located on an opposite wall forming said enclosure, and wherein upon operation of said air moving assembly, a two-stream converging air flow within said interior of said bay is formed generally extending from said two intake ports to said exhaust port.

* * * * *